US011820540B2

(12) United States Patent
Sanibondi et al.

(10) Patent No.: US 11,820,540 B2
(45) **Date of Patent: *Nov. 21, 2023**

(54) PACKAGING APPARATUS FOR FORMING SEALED PACKAGES

(71) Applicant: Tetra Laval Holdings & Finance S.A., Pully (CH)

(72) Inventors: Paolo Sanibondi, Reggio Emilia (IT); Claudio Ferrari, Albinea (IT); Nicola Garuti, Scandiano (IT); Nicola Macini, Modena (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

This patent is subject to a terminal disclaimer.

(21) Appl. No.: 17/250,843

(22) PCT Filed: Sep. 4, 2019

(86) PCT No.: PCT/EP2019/073597

§ 371 (c)(1),
(2) Date: Mar. 11, 2021

(87) PCT Pub. No.: WO2020/053050

PCT Pub. Date: Mar. 19, 2020

(65) Prior Publication Data

US 2022/0048657 A1 Feb. 17, 2022

(30) Foreign Application Priority Data

Sep. 11, 2018 (EP) ..... 18193695

(51) Int. Cl.
*B65B 9/20* (2012.01)
*B65B 31/02* (2006.01)
(Continued)

(52) U.S. Cl.
CPC ..... *B65B 31/021* (2013.01); *B65B 9/12* (2013.01); *B65B 9/207* (2013.01); *B65B 9/2028* (2013.01);
(Continued)

(58) Field of Classification Search
CPC B65B 9/20; B65B 9/2035; B65B 9/12; B65B 9/2049; B65B 9/207; B65B 55/103; B65B 31/045; B65B 31/021; B65B 57/145
See application file for complete search history.

(56) References Cited

U.S. PATENT DOCUMENTS 2,899,875 A 8/1959 Leasure
3,408,242 A 10/1968 Rochla
(Continued)

FOREIGN PATENT DOCUMENTS

CH 676958 A5 3/1991
CN 1688483 10/2005
(Continued)

OTHER PUBLICATIONS

International Search Report and Written Opinion of PCT/EP2019/073597, dated Nov. 27, 2019, in 9 pages.
(Continued)

*Primary Examiner* — Andrew M Tecco
(74) *Attorney, Agent, or Firm* — Knobbe, Martens, Olson & Bear, LLP

(57) ABSTRACT

There is described a packaging apparatus (1) for forming a plurality of sealed packages (2) from a tube (3) of a web of packaging material (4) which is continuously filled with a pourable product. The packaging apparatus comprises an isolation chamber (10) separating an inner environment (11) containing a sterile gas from an outer environment (12). The packaging apparatus further comprises a delimiting element (48) arranged, in use, within the tube (3) and being designed
(Continued)

to divide the tube (3), in use, into a first space (49) and a second space (50). The packaging apparatus (1) also comprises a pressurizing device (47) for pressurizing the second space (50) by means of a pressurized sterile gas. The delimiting element (48) is arranged within the isolation chamber (10).

20 Claims, 3 Drawing Sheets

(51) Int. Cl.
*B65B 9/12* (2006.01)
*B65B 9/207* (2012.01)
*B65B 31/04* (2006.01)
*B65B 51/26* (2006.01)

(52) U.S. Cl.
CPC ..... *B65B 9/2049* (2013.01); *B65B 31/045* (2013.01); *B65B 51/26* (2013.01); *B65B 2210/06* (2013.01)

(56) References Cited

U.S. PATENT DOCUMENTS 3,466,841 A * 9/1969 Rausing ..... B65B 55/103 426/410
3,580,788 A 5/1971 Gustafson
3,721,534 A 3/1973 Kubick
3,808,074 A 4/1974 Smith et al.
3,854,874 A * 12/1974 Loliger ..... B65B 55/103 118/DIG. 10
3,864,186 A 2/1975 Balla
3,884,746 A 5/1975 Loliger et al.
3,890,125 A 6/1975 Schoeck
4,169,004 A 9/1979 Kock et al.
4,506,125 A 3/1985 Smets
4,704,509 A 11/1987 Hilmersson
4,721,242 A 1/1988 Reil
4,757,175 A 7/1988 Mohr et al.
4,776,980 A 10/1988 Ruffini
4,784,697 A * 11/1988 Bordini ..... B65B 55/02 53/551
4,808,326 A 2/1989 Tanino et al.
4,809,485 A * 3/1989 Nielsen ..... B65B 39/00 53/503
5,044,140 A * 9/1991 Iwano ..... B67C 3/002 141/90
5,200,587 A 4/1993 Fang
5,250,140 A 10/1993 Hayashi et al.
5,260,535 A 11/1993 Holmström et al.
5,286,941 A 2/1994 Bel
5,418,069 A 5/1995 Learman
5,418,811 A 5/1995 Ruffini et al.
5,518,578 A 5/1996 Persells
5,588,019 A 12/1996 Ruffini et al.
5,649,407 A 7/1997 Blomqvist
5,714,033 A 2/1998 Hayashi et al.
5,889,263 A 3/1999 Andersson
5,968,399 A 10/1999 Selberg
6,012,267 A 1/2000 Katsumata
6,167,681 B1 1/2001 Yano et al.
6,216,420 B1 4/2001 Mazetto
6,430,899 B1 8/2002 Cicha
6,503,963 B2 1/2003 Toyoda et al.
6,588,174 B2 * 7/2003 Yamamoto ..... B65B 41/18 53/64
6,837,025 B2 1/2005 Kume et al.
7,002,117 B2 2/2006 Thomasset
7,003,934 B1 2/2006 Yano
7,827,768 B2 * 11/2010 Rosberg ..... B65B 9/20 53/551
8,572,936 B2 11/2013 Mancin et al.
8,707,661 B2 * 4/2014 Kinoshita ..... B29C 66/81429 53/503
8,707,662 B2 * 4/2014 Borsari ..... B29C 66/83413 53/550
8,839,597 B2 9/2014 Babini et al.
8,938,938 B2 * 1/2015 Konno ..... B29C 66/1122 53/554
8,943,786 B2 * 2/2015 Konno ..... B29C 65/7451 53/511
9,238,515 B2 * 1/2016 Persson ..... B65B 9/20
9,352,869 B2 5/2016 Babini et al.
9,545,751 B2 1/2017 Hull
9,637,260 B2 * 5/2017 Ghirardello ..... B65B 51/30
10,160,162 B2 12/2018 Bierlein et al.
10,350,829 B2 7/2019 Sandberg et al.
10,350,832 B2 7/2019 Karlsson et al.
10,358,243 B2 7/2019 Israelsson et al.
10,414,098 B2 9/2019 Aurand et al.
10,486,839 B2 11/2019 Kogure et al.
10,494,125 B2 * 12/2019 Andersson ..... B65B 31/045
10,773,846 B2 9/2020 Gentili et al.
10,875,675 B2 * 12/2020 Benedetti ..... B65B 55/04
10,919,238 B2 2/2021 Lancelotti et al.
10,994,495 B2 5/2021 Israelsson et al.
11,554,555 B2 1/2023 Keikhaee et al.
2001/0017021 A1 8/2001 Sanfilippo et al.
2001/0047641 A1 * 12/2001 Kume ..... B65B 51/303 53/493
2002/0047009 A1 4/2002 Flugstad et al.
2002/0108705 A1 8/2002 Kume et al.
2003/0116886 A1 6/2003 Nakazawa
2003/0230941 A1 12/2003 Jacobs
2004/0045635 A1 3/2004 Bandyopadhyay et al.
2004/0060928 A1 4/2004 Balla
2004/0182046 A1 9/2004 Babini et al.
2005/0076612 A1 * 4/2005 Andersson ..... B65B 55/103 53/551
2005/0241277 A1 11/2005 Yano et al.
2006/0124626 A1 6/2006 Kupfer et al.
2006/0154052 A1 7/2006 Waffenschmidt et al.
2007/0251196 A1 11/2007 Shokri et al.
2009/0101286 A1 4/2009 Sumeer et al.
2009/0223173 A1 * 9/2009 Rapparini ..... B65B 55/106 53/469
2010/0025391 A1 2/2010 Palombini et al.
2010/0155390 A1 6/2010 Hirota
2010/0180545 A1 7/2010 Palmquist et al.
2010/0243155 A1 9/2010 Andrews
2011/0030315 A1 2/2011 Mancin
2011/0094672 A1 4/2011 Wijk et al.
2011/0099955 A1 * 5/2011 Konno ..... B65B 55/025 53/545
2011/0185686 A1 * 8/2011 Konno ..... B29C 66/92921 53/548
2011/0192113 A1 * 8/2011 Kinoshita ..... B65B 9/2049 53/52
2011/0225929 A1 9/2011 Donati et al.
2012/0266571 A1 * 10/2012 Persson ..... B65B 31/045 53/473
2013/0119044 A1 5/2013 Gynnild
2013/0063556 A1 10/2013 Babini et al.
2014/0196407 A1 * 7/2014 Ghirardello ..... B65B 9/20 53/167
2015/0266603 A1 9/2015 Aul et al.
2016/0122051 A1 * 5/2016 Andersson ..... B65B 31/045 53/510
2016/0221250 A1 8/2016 Alexandersson et al.
2016/0229118 A1 8/2016 Palmquist et al.
2016/0297121 A1 10/2016 Palmquist et al.
2017/0182702 A1 6/2017 Mach et al.
2017/0240309 A1 8/2017 Runini et al.
2018/0243996 A1 8/2018 Bates et al.
2018/0250888 A1 9/2018 Mach
2018/0272620 A1 9/2018 Persson
2019/0152161 A1 5/2019 Palmquist et al.
2020/0101678 A1 4/2020 Keikhaee et al.
2020/0148406 A1 5/2020 Svard et al.
2021/0245902 A1 8/2021 Donati
2021/0331426 A1 10/2021 Sanibondi et al.
2022/0127031 A1 4/2022 Karlsson et al.

(56) References Cited

U.S. PATENT DOCUMENTS

FOREIGN PATENT DOCUMENTS

| | | |
|---|---|---|
| CN | 102181156 | 9/2011 |
| CN | 103501982 | 1/2014 |
| CN | 105073368 | 11/2015 |
| CN | 107406160 | 11/2017 |
| DE | 19815439 | 10/1999 |
| DE | 102015102860 | 9/2016 |
| EP | 0147833 | 7/1985 |
| EP | 0212490 | 3/1987 |
| EP | 0223517 | 5/1987 |
| EP | 0225392 | 6/1987 |
| EP | 0466271 | 1/1992 |
| EP | 0484998 | 5/1992 |
| EP | 0495699 | 7/1992 |
| EP | 0653899 | 5/1995 |
| EP | 0730946 | 9/1996 |
| EP | 0796718 | 9/1997 |
| EP | 0819607 | 1/1998 |
| EP | 0950608 | 10/1999 |
| EP | 0798216 | 11/2000 |
| EP | 1066951 | 1/2001 |
| EP | 1107358 | 6/2001 |
| EP | 1125844 | 8/2001 |
| EP | 0706945 | 10/2001 |
| EP | 1231149 | 8/2002 |
| EP | 1234771 | 8/2002 |
| EP | 1241098 | 9/2002 |
| EP | 1270182 | 1/2003 |
| EP | 1300340 | 4/2003 |
| EP | 1334911 | 8/2003 |
| EP | 1535843 | 6/2005 |
| EP | 1541641 | 6/2005 |
| EP | 3053834 | 8/2005 |
| EP | 1413520 | 8/2006 |
| EP | 1790572 | 5/2007 |
| EP | 2008795 | 12/2008 |
| EP | 2026630 | 2/2009 |
| EP | 2236270 | 10/2010 |
| EP | 2343242 | 7/2011 |
| EP | 2468480 | 6/2012 |
| EP | 2695816 | 2/2014 |
| EP | 2781325 | 9/2014 |
| EP | 3000584 | 3/2016 |
| EP | 2448829 | 6/2016 |
| EP | 3241667 | 11/2017 |
| EP | 3254979 | 12/2017 |
| EP | 3261932 | 12/2018 |
| EP | 3303151 | 7/2019 |
| FR | 1433873 | 4/1966 |
| FR | 2073137 | 9/1971 |
| FR | 2776616 | 10/1999 |
| GB | 789981 | 1/1958 |
| GB | 2506681 | 4/2014 |
| IN | 10126 | 8/2014 |
| JP | S57148619 | 9/1982 |
| JP | S 63-23900 B | 5/1988 |
| JP | S63-187591 | 8/1988 |
| JP | S63-258729 | 10/1988 |
| JP | H04-6025 | 1/1992 |
| JP | H 04-72141 A | 3/1992 |
| JP | H04-154564 | 5/1992 |
| JP | H08-244728 | 9/1996 |
| JP | H09-077006 | 3/1997 |
| JP | H10-321361 | 12/1998 |
| JP | H11-43115 | 2/1999 |
| JP | H11-514319 | 12/1999 |
| JP | 2000-127198 | 5/2000 |
| JP | 2002-046703 A | 2/2002 |
| JP | 2004-228043 | 8/2004 |
| JP | 2009012354 | 1/2009 |
| JP | 2009-149365 | 7/2009 |
| JP | 2015-16894 | 1/2015 |
| RU | 2096280 C1 | 11/1997 |
| SE | 434240 | 7/1984 |
| SU | 1551588 A1 | 3/1990 |
| SU | 1413026 A1 | 7/1998 |
| WO | WO 1992/015182 | 9/1992 |
| WO | WO 1997/14547 | 4/1997 |
| WO | WO 1999/029574 | 6/1999 |
| WO | WO 2001/085827 | 11/2001 |
| WO | WO 2003/053626 | 7/2003 |
| WO | WO 2003/097332 | 11/2003 |
| WO | WO 2005/004560 | 1/2005 |
| WO | WO 2005/105579 | 11/2005 |
| WO | WO 2005/110855 | 11/2005 |
| WO | WO 2007/008131 | 1/2007 |
| WO | WO 2009/139129 | 11/2009 |
| WO | WO 2010/136756 | 12/2010 |
| WO | WO 2011/075055 | 6/2011 |
| WO | WO 2012/019925 | 2/2012 |
| WO | WO 2013/045254 | 4/2013 |
| WO | WO 2014/072477 | 5/2014 |
| WO | WO 2014/166765 | 10/2014 |
| WO | WO 2015/036222 | 3/2015 |
| WO | WO 2015/040173 | 3/2015 |
| WO | WO 2015/158502 | 10/2015 |
| WO | WO 2016/052689 | 4/2016 |
| WO | WO 2016/083212 | 6/2016 |
| WO | WO 2016/132986 | 8/2016 |
| WO | WO 2017/089186 | 6/2017 |
| WO | WO 2017/089187 | 6/2017 |

OTHER PUBLICATIONS

International Search Report and Written Opinion of PCT/EP2019/073595, dated Nov. 4, 2019, in 10 pages.

Davis, J.R., "Practical Design Guidelines for Surface Engineering"Chapter 8, Surface Engineering for Corrosion and Vear Resistance, ASM International, Mar. 2001 ; eISBN: 9781615030729, pISBN: 9780871707000; pp. 195-229.

Leschynsky et al "Layered Alloys for Effective Magnetic Flux Concentration in Induction Heating,"Materials Science—Poland, vol. 25, No. 2, 2007.

* cited by examiner 47
59
53
10
11
12
55
31
58
49
32
54
57
56
51
45
48
52
33
3
43
46
50
34
35
37
37
36
38
6
39
2
6

PACKAGING APPARATUS FOR FORMING SEALED PACKAGES

TECHNICAL FIELD

The present invention relates to a packaging apparatus for forming sealed packages, in particular for forming sealed packages filled with a pourable product.

BACKGROUND ART

As is known, many liquid or pourable food products, such as fruit juice, UHT (ultra-high-temperature treated) milk, wine, tomato sauce, etc., are sold in packages made of sterilized packaging material.

A typical example is the parallelepiped-shaped package for liquid or pourable food products known as Tetra Brik Aseptic (registered trademark), which is made by sealing and folding laminated strip packaging material. The packaging material has a multilayer structure comprising a base layer, e.g. of paper, covered on both sides with layers of heat-seal plastic material, e.g. polyethylene. In the case of aseptic packages for long-storage products, such as UHT milk, the packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

Packages of this sort are normally produced on fully automatic packaging apparatus, which advance a web of packaging material through a sterilization unit of the packaging apparatus for sterilizing the web of packaging material, e.g. by means of chemical sterilization (e.g. by applying a chemical sterilizing agent, such as a hydrogen peroxide solution) or physical sterilization (e.g. by means of an electron beam). Then, the sterilized web of packaging material is maintained and advanced within an isolation chamber (a closed and sterile environment), and is folded and sealed longitudinally to form a tube, which is further fed along a vertical advancing direction.

In order to complete the forming operations, the tube is continuously filled with a sterilized or sterile-processed pourable food product, and is transversally sealed and subsequently cut along equally spaced transversal cross sections within a package forming unit of the packaging apparatus during advancement along the vertical advancing direction.

Pillow packages are so obtained within the packaging apparatus, each pillow package having a longitudinal sealing band and a pair of top and bottom transversal sealing bands.

Furthermore, a typical packaging apparatus comprises a conveying device for advancing a web of packaging material along an advancement path, a sterilizing unit for sterilizing the web of packaging material, a tube forming device partially arranged within an isolation chamber and being adapted to form the tube from the advancing web of packaging material and to longitudinally seal the tube along a longitudinal seam portion of the tube, a filling pipe, in use, being coaxially arranged to and within the tube for continuously filling the tube with the pourable product and a package forming unit adapted to produce the single packages from the tube of packaging material by shaping, transversally sealing and transversally cutting the packages.

The package forming unit comprises a plurality of forming, sealing and cutting assemblies, each one, in use, advancing along a respective operative path parallel to the advancement path of the tube. During advancement of the forming, sealing and cutting assemblies these start to interact with the tube at a hit position and follow the advancing tube so as to shape, to transversally seal and to transversally cut the tube so as to obtain the single packages.

In order to correctly form the single packages, it is required that the hydrostatic pressure provided by the pourable product within the tube is sufficiently high as otherwise irregularly shaped packages would be obtained.

Typically, the column of pourable product present in the tube for providing the required hydrostatic pressure extends at least 500 mm upwards from the hit position (i.e. the station at which the respective forming, sealing and cutting assemblies start to contact the advancing tube). In some cases, the pourable product column extends up to 2000 mm upwards from the hit position. It is known in the art that the exact extension depends at least on the package format and the production speeds.

In practice, this means that the tube must have an extension so as to provide for the required pourable product column within the tube.

Therefore, the vertical extension of the isolation chamber of the packaging apparatus must be rather elevated in order to provide the needed level of pourable product within the tube.

The required hydrostatic pressure is dependent on production parameters, such as the advancement speed of the web of packaging material and, accordingly, of the advancement speed of the tube (in other words, it is dependent on the processing speed of the packaging apparatus), on the package format and the package volume. This means, that if any production parameter is to be varied, it is necessary that one or more operators modify the packaging apparatus accordingly. The needed modifications are lengthy in time and, thus, lead to increasing production costs.

A need is felt in the sector to improve the packaging apparatuses. In particular, so as to overcome at least one of the above-mentioned disadvantages.

DISCLOSURE OF INVENTION

It is therefore an object of the present invention to provide in a straightforward and low-cost manner an improved packaging apparatus.

According to the present invention, there is provided a packaging apparatus as claimed in claim 1.

Further advantageous embodiments of the packaging apparatus according to the invention are specified in the dependent claims.

BRIEF DESCRIPTION OF THE DRAWINGS

A non-limiting embodiment of the present invention will be described by way of example with reference to the accompanying drawings, in which.

BEST MODES FOR CARRYING OUT THE INVENTION

Figure 1:
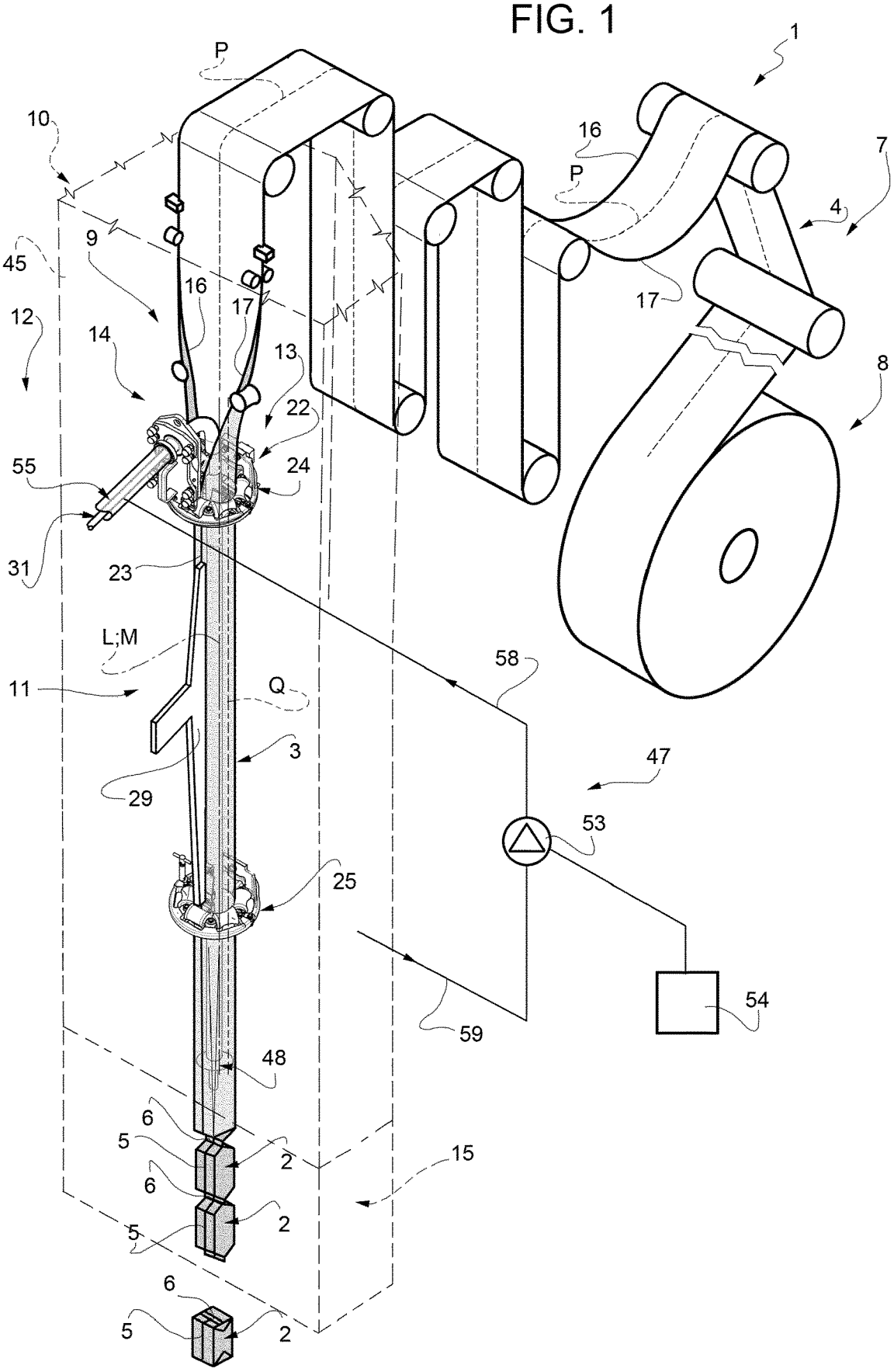
FIG. 1 is a schematic view of a packaging apparatus according to the present invention, with parts removed for clarity.

Number 1 indicates as a whole a packaging apparatus for producing sealed packages 2 of a pourable food product, in particular a sterilized and/or a sterile-processed pourable food product, such as pasteurized milk or fruit juice, from a tube 3 of a web 4 of packaging material. In particular, in use, tube 3 extends along a longitudinal axis L, in particular, axis L having a vertical orientation.

Web 4 of packaging material has a multilayer structure (not shown), and comprises at least a layer of fibrous material, such as e.g. a paper or cardboard layer, and at least two layers of heat-seal plastic material, e.g. polyethylene interposing the layer of fibrous material in between one another. One of these two layers of heat-seal plastic material defining the inner face of package 2 eventually contacting the pourable product.

Preferably but not necessarily, web 4 also comprises a layer of gas- and light-barrier material, e.g. aluminum foil or ethylene vinyl alcohol (EVOH) film, in particular being arranged between one of the layers of the heat-seal plastic material and the layer of fibrous material. Preferentially but not necessarily, web 4 also comprises a further layer of heat-seal plastic material being interposed between the layer of gas- and light-barrier material and the layer of fibrous material.

A typical package 2 obtained by packaging apparatus 1 comprises a sealed longitudinal seam portion 5 and a pair of transversal seal portions 6, in particular a pair of top and bottom transversal seal portions 6 (i.e. one transversal seal portion 6 at an upper portion of package 2 and another transversal seal portion 6 at a lower portion of package 2).

With particular reference to FIG. 1, packaging apparatus 1 comprises:

- a conveying device 7 configured to advance web 4 (in a manner known as such) along a web advancement path P from a delivery station 8 to a forming station 9, at which, in use, web 4 is formed into tube 3;
- an isolation chamber 10 having an inner environment 11, in particular an inner sterile environment, containing (comprising) a sterile gas, in particular sterile air, at a given gas pressure and being separated from an outer environment 12;
- a tube forming and sealing device 13 being at least partially arranged within isolation chamber 10 and being adapted to form and longitudinally seal tube 3, in particular at tube forming station 9, from the, in use, advancing web 4;
- a filling device 14 for continuously filling tube 3 with the pourable product; and
- a package forming unit 15 adapted to shape, to transversally seal and, preferably but not necessarily to transversally cut the, in use, advancing tube 3 for forming packages 2.

Preferably but not necessarily, packaging apparatus 1 also comprises a sterilizing unit (not shown and known as such) adapted to sterilize the, in use, advancing web 4 at a sterilization station, in particular the sterilization station being arranged upstream of forming station 9 along path P.

Preferentially but not necessarily, conveying device 7 is configured to advance tube 3 and, in particular also any intermediate of tube 3, in a manner known as such along a tube advancement path Q, in particular from forming station 9 to and at least partially through package forming unit 15.

In particular, with the wording intermediates of tube 3 any configuration of web 4 is meant prior to obtaining the tube structure and after folding of web 4 by tube forming device 13 has started. In other words, the intermediates of tube 3 are a result of the gradual folding of web 4 so as to obtain tube 3, in particular by overlapping with one another a first edge 16 of web 4 and a second edge 17 of web 4, opposite to first edge 16.

Preferentially but not necessarily, tube forming and sealing device 13 comprises a tube forming unit 22 at least partially, preferably fully, arranged within isolation chamber 10, in particular at tube forming station 9, and being adapted to (configured to) gradually fold the advancing web 4 into tube 3, in particular by overlapping first edge 16 and second edge 17 with one another, for forming a longitudinal seam portion 23 of tube 3. In particular, tube forming unit 22 extends along a longitudinal axis M, in particular having a vertical orientation.

In particular, seam portion 23 extends from an initial level (not specifically shown) into a downward direction along path Q. In other words, the initial level is at the position at which first edge 16 and second edge 17 start to overlap one another for forming seam portion 23.

In particular, at least a portion of path Q lies within isolation chamber 10 (in particular, within inner environment 11).

In more detail, axis L and axis M are parallel to one another. In even more detail, tube forming unit 22 defines, in use, axis L of tube 3.

Preferentially but not necessarily, tube forming unit 22 comprises at least two forming ring assemblies 24 and 25, in particular arranged within isolation chamber 10 (in particular, within inner environment 11), being adapted to gradually fold in cooperation with one another web 4 into tube 3, in particular by overlapping first edge 16 and second edge 17 with one another for forming longitudinal seam portion 23.

In the specific case shown, forming ring assembly 25 is arranged downstream of forming ring assembly 24 along path Q.

In particular, each one of forming ring assemblies 24 and 25 substantially lie within a respective plane, in particular each plane being orthogonal to axis M, even more particular each respective plane having a substantially horizontal orientation.

Even more particular, forming ring assemblies 24 and 25 are spaced apparat from and parallel to one another (i.e. the respective planes are parallel to and spaced apart from one another).

Preferentially but not necessarily, each plane is orthogonal to axis M and to axis L.

Furthermore, forming ring assemblies 24 and 25 are arranged coaxial to one another and define longitudinal axis M of tube forming unit 22.

More specifically, each forming ring assembly 24 and 25 comprises a respective support ring and a plurality of respective bending rollers mounted onto the respective support ring. In particular, the respective bending rollers are configured to interact with web 4 and/or tube 3 and/or any intermediates of tube 3 for forming tube 3. Even more particular, the respective bending rollers define respective apertures through which, in use, tube 3 and/or the intermediates of tube 3 advance.

Preferentially but not necessarily, tube forming and sealing device 13 also comprises a sealing unit adapted to (configured to) longitudinally seal tube 3 along seam portion 23. In other words, in use, seam portion 23 formed by tube forming unit 22 is sealed by activation of the sealing unit.

Preferentially but not necessarily, the sealing unit is at least partially positioned within isolation chamber 10.

It must be noted that the respective longitudinally sealed seam portion 5 of the single packages 2 result from cutting tube 3. In other words, the respective seam portions 5 of the single packages 2 are respective sections of seam portion 23 of tube 3.

Furthermore, the sealing unit comprises a sealing head 29 arranged within isolation chamber 10 and being adapted to (configured to) transfer thermal energy to tube 3, in particular to seam portion 23 for longitudinally sealing tube 3, in particular seam portion 23. Sealing head 29 can be of any type. In particular, sealing head 29 can be of the kind operating by means of induction heating and/or by a stream of a heated gas and/or by means of ultrasound and/or by laser heating and/or by any other means.

Preferentially but not necessarily, the sealing unit also comprises a pressing assembly (only partially shown) adapted to exert a mechanical force on tube 3, in particular on the substantially overlapping first edge 16 and second edge 17, even more particular onto seam portion 23, so as to ensure the longitudinal sealing of tube 3 along seam portion 23.

In particular, the pressing assembly comprises at least an interaction roller and a counter-interaction roller (not shown) adapted to exert the mechanical force onto seam portion 23 from opposite sides thereof. In particular, in use, seam portion 23 is interposed between the interaction roller and the counter-interaction roller.

Preferentially but not necessarily, the interaction roller is supported by forming ring assembly 25.

In more detail, sealing head 29 is arranged substantially between forming ring assemblies 24 and 25 (i.e. sealing head 29 is arranged between the respective planes of forming ring assemblies 24 and 25).

Figure 2:
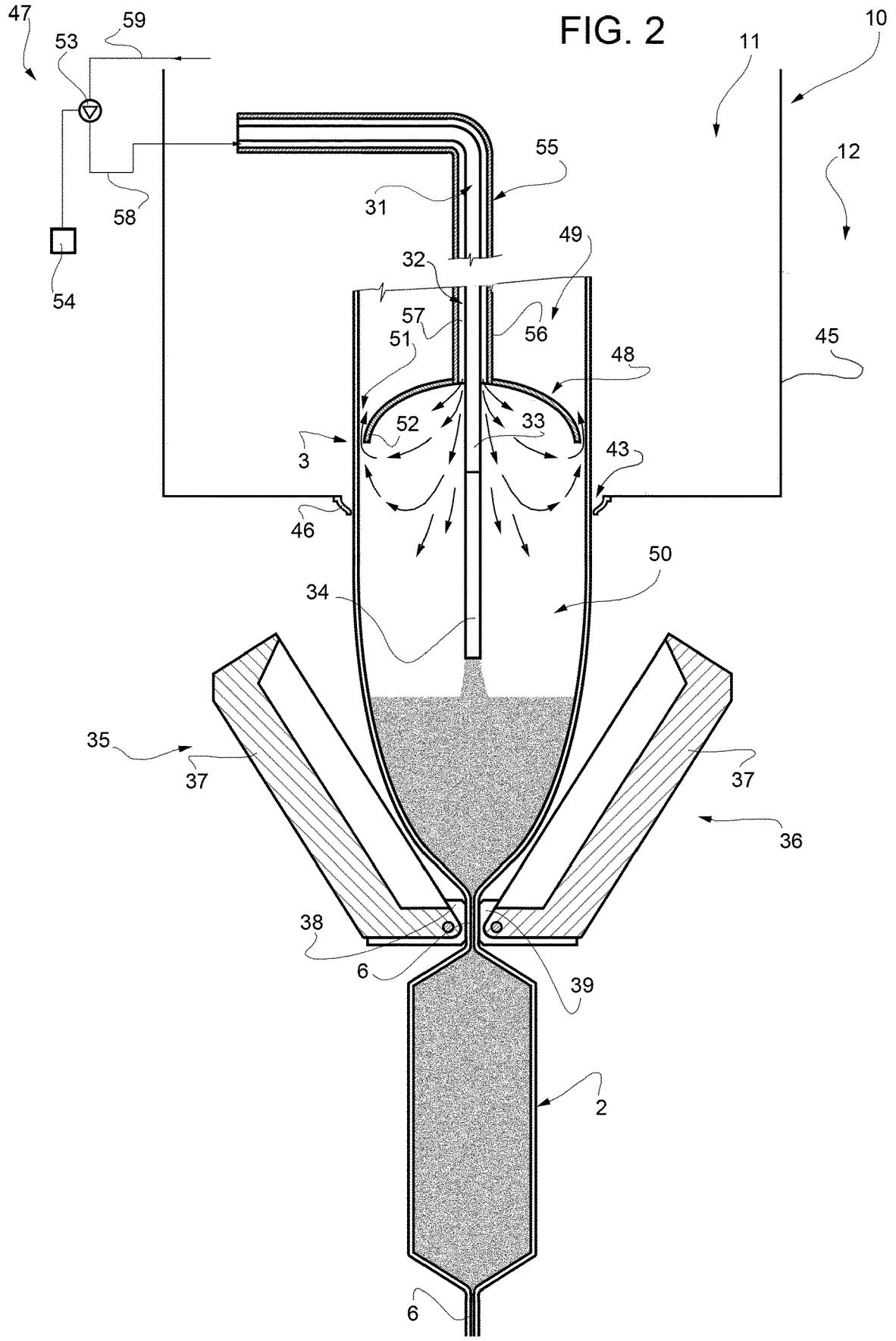
FIG. 2 is an enlarged view of a detail of the packaging apparatus of FIG. 1, with parts removed for clarity.

With particular reference to FIGS. 1 and 2, filling device 14 comprises a filling pipe 31 being in fluid connection with a pourable product storage tank (not shown and known as such), which is adapted to store/provide for the pourable product, in particular the sterilized and/or sterile-processed pourable food product, to be packaged.

In particular, filling pipe 31 is adapted to (configured to) direct, in use, the pourable product into tube 3.

Preferentially but not necessarily, filling pipe 31 is, in use, at least partially placed within tube 3 for continuously feeding the pourable product into tube 3.

In particular, filling pipe 31 comprises a linear main pipe portion 32 of filling pipe 31 extending within and parallel to tube 3, i.e. parallel to axis M and axis L.

Preferentially but not necessarily, main pipe portion 32 comprises an upper section 33 and a lower section 34 removably coupled to one another. In further detail, lower section 34 comprises an outlet opening from which the pourable product is fed, in use, into tube 3.

According to the preferred non-limiting embodiment as shown in FIG. 2, package forming unit 15 comprises a plurality of pairs of at least one respective operative assembly 35 (only one shown) and at least one counter-operative assembly 36 (only one shown); and

- in particular, a conveying device (not shown and known as such) adapted to advance the respective operative assemblies 35 and the respective counter-operative assemblies 36 of the pairs along respective conveying paths.

In more detail, each operative assembly 35 is adapted to cooperate, in use, with the respective counter-operative assembly 36 of the respective pair for forming a respective package 2 from tube 3. In particular, each operative assembly 35 and the respective counter-operative assembly 36 are configured to shape, to transversally seal and, preferably but not necessarily also to transversally cut, tube 3 for forming packages 2.

In further detail, each operative assembly 35 and the respective counter-operative assembly 36 are adapted to cooperate with one another for forming a respective package 2 from tube 3 when advancing along a respective operative portion of the respective conveying path. In particular, during advancement along the respective operative portion each operative assembly 35 and the respective counter-operative assembly 36 advance parallel to and in the same direction as tube 3.

In even more detail, each operative assembly 35 and the respective counter-operative assembly 36 are configured to contact tube 3 when advancing along the respective operative portion of the respective conveying path. In particular, each operative assembly 35 and the respective counter-operative assembly 36 are configured to start to contact tube 3 at a (fixed) hit position.

More specifically, each operative assembly 35 and counter-operative assembly 36 comprises:

- a half-shell 37 adapted to contact tube 3 and to at least partially define the shape of packages 2;
- one of a sealing element 38 or a counter-sealing element 39, adapted to transversally seal tube 3 in a known manner between adjacent packages 2 for obtaining transversal seal portions 6; and
- preferably but not necessarily, one of a cutting element (not shown and known as such) or a counter-cutting element (not shown and known as such) for transversally cutting tube 3 between adjacent packages 2, in particular between the respective transversal seal portions 6, in a manner known as such.

In particular, each half-shell 37 is adapted to be controlled between a working position and a rest position by means of a driving assembly (not shown). In particular, each half-shell 37 is adapted to be controlled into the working position with the respective operative assembly 35 or the respective counter-operative assembly 36, in use, advancing along the respective operative portion.

Preferentially but not necessarily, filling device 14 is configured to direct the pourable product, in particular through filling pipe 31, into tube 3 such that the extension of the pourable product column present in tube 3 from the hit position in an upstream direction (with respect to path Q) is less than 500 mm. Even more preferably, the extension of the pourable product column from the hit position in the upstream direction should lie within a range of about 100 mm to 500 mm.

With particular reference to FIGS. 1 and 2, isolation chamber 10 comprises an outlet-opening 43 for allowing tube 3 to exit isolation chamber 10 during advancement along path Q. In particular, outlet-opening 43 is arranged downstream of tube forming station 9 along path Q.

Preferably but not necessarily, outlet-opening 43 is arranged in the area of a downstream (end) portion of isolation chamber 10.

Preferentially but not necessarily, isolation chamber 10 also comprises an inlet-opening, opposite to outlet-opening 43, and configured to allow entrance of (sterile) web 4 into isolation chamber 10. In particular, the inlet-opening is positioned in an upstream portion of isolation chamber 10.

According to the preferred non-limiting embodiment disclosed, isolation chamber 10 comprises a housing 45 (only schematically shown in FIGS. 1 and 2) delimiting the inner environment 11 (i.e. housing 45 separates inner environment 11 from outer environment 12).

Preferentially but not necessarily, housing 45 comprises at least outlet-opening 43 and, in particular also the inlet-opening.

According to a preferred non-limiting embodiment, isolation chamber 10 comprises at least one (downstream) sealing assembly configured to seal, in use, outlet-opening 43 in cooperation with the, in use, advancing tube 3. In particular, the (downstream) sealing assembly is configured to at least partially hinder, in particular to (substantially) impede, entrance of gas from outside of isolation chamber 10 (i.e. from outer environment 12) through outlet-opening 43 into isolation chamber 10. In other words, the (downstream) sealing assembly is configured to at least partially impede a flow of gas from outer environment 12 into inner environment 11.

Preferentially but not necessarily, the (downstream) sealing assembly comprises at least one sealing element, in particular at least one gasket 46 configured to interact with, in particular to contact, the, in use, advancing tube 3 and, in particular also a carrier structure (not shown) carrying gasket 46 and being coupled to housing 45 in the area of outlet-opening 43.

According to the preferred non-limiting embodiment disclosed, inner environment 11 comprises (i.e. contains) the sterile gas, in particular the sterile air, at a given pressure. Preferentially but not necessarily, the given pressure is slightly above ambient pressure for reducing the risk of any contaminants and/or contaminations entering inner environment 11. In particular, the given pressure is about 100 Pa to 500 Pa (0.001 bar to 0.005 bar) above ambient pressure.

Preferentially but not necessarily, packaging apparatus 1 comprises a pressurizing device 47 (only partially shown to the extent necessary for the comprehension of the invention disclosed) configured to at least feed the sterile gas, in particular the sterile air, into isolation chamber 10, in particular inner environment 11.

According to the present invention and with particular reference to FIG. 2, packaging apparatus 1 also comprises a delimiting element 48 placed, in use, within tube 3 and designed to divide tube 3, in use, into a first space 49 and a second space 50.

Advantageously, delimiting element 48 is arranged within isolation chamber 10.

In comparison of e.g. placing delimiting element 48 within package forming unit 15 the arrangement of delimiting element 48 is preferred for the following reasons. It is known that tube 3 extends within at least a portion of inner environment 11, which is preferably a sterile inner environment 11, and within at least a portion of package forming unit 15, which typically does not comprise a sterile environment. Since delimiting element 48 is arranged within isolation chamber 10, in the case of a collapse (loss of integrity) of tube 3 and/or seam portion 23 in the area of delimiting element 48—in the worst case—sterile gas and not non-sterile (contaminated) gases would contact the inside of tube 3 and/or filling pipe 31 and/or delimiting element 48 and/or gas feeding pipe 55. In other words, in the case of the occurrence of a loss of integrity (e.g. the occurrence of a hole) within tube 3, in proximity of delimiting element 48, a flow of gas may enter into tube 3. As the delimiting element 48 is arranged within isolation chamber 10 this gas would be sterile gas, thus avoiding any possible contamination, in contrast to what would happen if the same occurred with delimiting element 48 being arranged within package forming unit 15. In the latter case, after occurrence of gas entering tube 3 from within package forming unit 15, a sterilization-in-place step would be required.

According to a preferred non-limiting embodiment, delimiting element 48 is arranged upstream of outlet-opening 43 along tube advancement path Q.

In more detail, first space 49 is delimited by tube 3, in particular the walls of tube 3, and delimiting element 48. Furthermore, first space 49 opens into inner environment 11. Even more particular, delimiting element 48 delimits first space 49 at a downstream portion (with respect to path Q), in particular a bottom portion, of first space 49 itself.

In more detail, second space 50 is delimited, in use, by tube 3, in particular the walls of tube 3, delimiting element 48 and the transversal seal portion 6 of one respective package 2 (to be formed).

In other words, second space 50 extends in a direction parallel to path Q (i.e. parallel to axis L) from delimiting element 48 to transversal seal portion 6.

In even other words, delimiting element 48 delimits second space 50 at an upstream portion (with respect to path Q), in particular an upper portion, of second space 50 itself; and transversal seal portion 6 delimits second space 50 at a downstream portion (with respect to path Q), in particular a bottom portion, of second space 50 itself.

In further detail, first space 49 is arranged upstream of second space 50 along tube advancement path Q. Even more particular, first space 49 is arranged upstream of delimiting element 48 along path Q and second space 50 is arranged downstream of delimiting element 48 along path Q. In the specific example shown, second space 50 is placed below first space 49.

According to the preferred non-limiting embodiment disclosed, pressurizing device 47 is also adapted to (configured to), in particular to continuously, direct, in use, a flow of sterile gas into second space 50 for obtaining a gas pressure within second space 50 that is higher than the gas pressure within first space 49.

In particular, as will become clear from the following description, second space 50 defines a high-pressure zone within tube 3 and first space 49 defines a low-pressure zone within tube 3.

In the context of the present application, high-pressure zone is to be understood such that the internal pressure lies in a range of about 5 kPa to 40 kPa (0.05 bar to 0.40 bar), in particular of about 10 kPa to 30 kPa (0.10 bar to 0.30 bar) above ambient pressure (i.e. the pressure within second space 50 lies in a range of about 5 kPa to 40 kPa (0.05 bar to 0.40 bar), in particular of about 10 kPa to 30 kPa (0.10 bar to 0.30 bar) above ambient pressure). In other words, second space 50 is overpressurized.

Low-pressure zone is to be understood such that the pressure is slightly higher than the ambient pressure. In particular, only slightly higher than the ambient pressure means that the pressure lies preferably in a range between 100 Pa to 500 Pa (0.001 bar to 0.005 bar) above ambient pressure.

Preferably but not necessarily, first space 49 is in (direct) fluidic connection with inner environment 11. Thus, sterile gas present in the first space 49 can flow to inner environment 11.

In particular, tube 3 (and its intermediates) lie(s) at least partially within isolation chamber 10 (in particular, within inner environment 11).

Preferentially, the pressure inside first space 49 (substantially) equals the given pressure present in isolation chamber 10, in particular in inner environment 11. In other words, preferentially, the pressure inside first space 49 ranges between 100 Pa to 500 Pa (0.001 bar to 0.005 bar) above ambient pressure.

More specifically, delimiting element 48 is arranged, in use, downstream of the above-mentioned initial level along path Q. In other words, delimiting element 48 is positioned below the point from which seam portion 23 extends along a downstream direction (with respect to path Q). In even other words, delimiting element 48 is arranged below the position from which first edge 16 and second edge 17 are superimposed for forming seam portion 23.

In further detail, second space 50 is delimited by delimiting element 48 and the respective transversal seal portion 6 of the respective package 2, in particular the transversal seal portion 6 being, in use, placed downstream of delimiting element 48.

Furthermore, in use, filling device 14, in particular filling pipe 31, is adapted to (configured to) direct the pourable product into second space 50. Thus, in use, second space 50 contains the pourable product and the pressurized sterile gas. The pressurized sterile gas provides for the required hydrostatic force needed for a correct forming of packages 2 (i.e. in other words, the sterile gas replaces the effect of the pourable product column within tube 3).

Preferably but not necessarily, delimiting element 48 is designed to provide, in use, for at least one fluidic channel 51, in particular having an annular shape, for fluidically connecting second space 50 with first space 49 allowing for, in use, a leakage flow of sterile gas from second space 50 into first space 49. In particular, in use, the sterile gas leaks from second space 50 (the high-pressure zone) to first space 49 (the low-pressure zone) through fluidic channel 51. By providing for fluidic channel 51 it is possible to control the gas pressure within second space 50 with an increased accuracy.

Preferentially but not necessarily, in use, delimiting element 48 is designed such that, in use, fluidic channel 51 is provided by a gap between the inner surface of tube 3 and delimiting element 48, in particular a peripheral portion 52 of delimiting element 48.

As an alternative or in addition, delimiting 48 element could comprise one or more passages for allowing a fluidic connection between first space 49 and second space 50.

Preferably but not necessarily, delimiting element 48 is arranged such that, in use, fluidic channel 51 is delimited by peripheral portion 52 and the inner surface of the, in use, advancing tube 3. In other words, in use, delimiting element 48 and the inner surface of tube 3 do not touch each other. Thus, no wear of delimiting element 48 occurs due to an interaction between delimiting element 48 and tube 3. As well, delimiting element 48 does not damage, in use, the inner surface of tube 3.

In further detail, delimiting element 48 has a radial extension being smaller than the inner diameter of tube 3. Preferentially but not necessarily, in case of a format change leading to a change of the inner diameter of tube 3, delimiting element 48 can be replaced by a new delimiting element 48.

In the specific case shown, delimiting element 48 has a curved outer profile. Alternatively, other configurations of delimiting element 48 could be chosen, such as having a substantially straight shape or having a straight central portion and a curved peripheral portion.

Preferentially but not necessarily, pressurizing device 47 is configured to allow for a variable flow of sterile gas (i.e. adapted to control varying flow rates) by maintaining a substantially constant gas pressure within second space 50 at various flow rates.

In particular, pressurizing device 47 is configured to provide for a variable flow of sterile gas of about 10 to 200 Nm3/h, in particular of 20 to 180 Nm3/h, even more particular of about 25 to 150 Nm3/h.

Preferentially but not necessarily, pressurizing device 47 is adapted to vary the flow of sterile gas in dependence of the sterile gas flowing from second space 50 to first space 49, in particular through at least fluidic channel 51. Such a configuration of pressurizing device 47 is advantageous as tube 3, in use, slightly fluctuates, meaning that the diameter (or equivalently the radius) slightly fluctuates in use, in particular due to minor variations in the extension of the overlap of first edge 16 and second edge 17. This again results in fluctuations of the size of fluidic channel 51 and, consequently, of the amount of sterile gas flowing from second space 50 to first space 49 through fluidic channel 51.

In other words, in dependence of the amount of sterile gas passing from second space 50 to first space 49, in particular through fluidic channel 51, pressurizing device 47 is configured to control the flow of sterile gas into second space 50 and, at the same time, to maintain the pressure within second space 50 substantially constant.

Preferably but not necessarily, pressurizing device 47 is configured such that a higher loss of sterile gas from second space 50 to first space 49 is compensated for by an increased flow of sterile gas into second space 50 and the substantial maintenance of a constant pressure within second space 50 (and consequently, a decreased loss of sterile gas from second space 50 to first space 49 is compensated for by a decreased flow of sterile gas into second space 50 by substantially maintaining the pressure within second space 50 constant).

Preferentially but not necessarily, pressurizing device 47 is adapted to (configured to) control the gas pressure within second space 50 to range between 5 kPa to 40 kPa (0.05 bar to 0.40 bar), in particular between 10 kPa to 30 kPa (0.10 bar to 0.30 bar), above ambient pressure.

Advantageously but not necessarily, pressurizing device 47 comprises a closed sterile gas circuit from inner environment 11 into second space 50 and back into inner environment 11. This allows a simplified overall construction of apparatus 1, in particular related to the control and the supply of the sterile gas.

According to the preferred non-limiting embodiment disclosed, pressurizing device 47 is adapted to withdraw sterile gas from inner environment 11, to pressurize (to compress) the sterile gas and to direct the pressurized (compressed) sterile gas into second space 50.

Preferentially but not necessarily, pressurizing device 47 comprises at least:

- one pumping device 53 configured to withdraw sterile gas from inner environment 11, to pressurize (to compress) the sterile gas and to direct the pressurized sterile gas into second space 50; and
- one control unit 54 adapted to control operation of pumping device 53.

Preferentially but not necessarily, pumping device 53 is a rotary machine, even more particular a compressor.

Preferably but not necessarily, the rotary machine, in particular the compressor is configured to operate at high rotation speeds. More specifically, the rotary machine, in particular the compressor, is configured to operate at rotation speeds ranging between 10000 to 100000 rpm, in particular 20000 to 80000 rpm, even more particular 30000 to 60000 rpm.

In more detail, control unit 54 is adapted to (configured to) control at least one of the operating parameters, in particular the rotation speed, of pumping device 53, in particular the rotary machine, even more particular the compressor, as a function of at least one of the advancement speed of web 4 and/or the advancement speed of tube 3 (both advancement speeds are equal) and/or the format or the shape of packages 2 to be formed and/or the volume of packages 2 to be formed.

Figure 3:
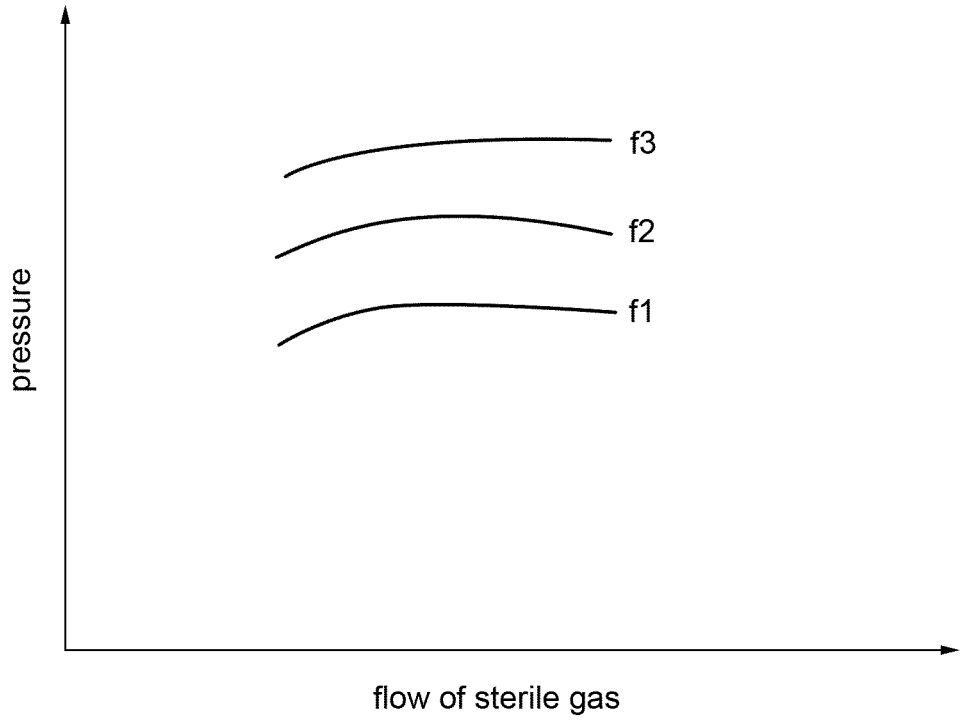
FIG. 3 shows characteristic operational curves of a component of the packaging apparatus of FIG. 1.

Preferably and with particular reference to FIG. 3, the rotary machine, in particular the compressor, is configured such that the pressure provided increases with increasing rotation speed.

FIG. 3 illustrates three examples of "pressure—flow of sterile gas"-curves at three different rotation speeds indicated as f1, f2 and f3 with f1 being smaller than f2 and f2 being smaller than f3.

Preferably but not necessarily, the rotary machine, in particular the compressor, is configured to allow for a variable flow of sterile gas by maintaining a substantially constant gas pressure within second space 50, in particular as a function of the flow of gas from second space 50 to first space 49 (through fluidic channel 51).

The three exemplary "pressure—flow of sterile gas"-curves of FIG. 3 indicate that the curves have a substantially flat profile. This means that a change in the flow of sterile gas has substantially no influence on the pressure provided for by the rotary machine, in particular the compressor.

Preferably but not necessarily, pressurizing device 47 comprises a gas feeding pipe 55 being at least indirectly fluidically connected with inner environment 11 and second space 50 for directing the sterile gas from inner environment 11 into second space 50. In particular, gas feeding pipe 55 is directly fluidically connected with second space 50. Preferentially but not necessarily, gas feeding pipe 55 is at least indirectly connected with pumping device 53, in particular the rotary machine, even more particular the compressor.

In more detail, gas feeding pipe 55 comprises at least a main portion 56, which, in use, extends within tube 3. In particular, main portion 56 extends parallel, preferentially but not necessarily coaxial, to main pipe portion 32.

In the specific example shown, filling pipe 31 extends at least partially within gas feeding pipe 55. Alternatively, gas feeding pipe 55 could at least partially extend within filling pipe 31.

In more detail, at least main pipe portion 32 extends at least partially within main portion 56.

In particular, the cross-sectional diameter of main pipe portion 32 is smaller than the cross-section diameter of main portion 56.

Preferentially but not necessarily, gas feeding pipe 55 and filling pipe 31 define/delimit an annular conduit 57 for the sterile gas to be fed into second space 50. In particular, annular conduit 57 is delimited by the inner surface of gas feeding pipe 55 and the outer surface of filling pipe 31.

In other words, in use, the sterile gas is directed into second space 50 through annular conduit 57.

Pressurizing device 47 also comprise:

- a gas conduit 58 being in direct fluidic connection with pumping device 53, in particular the rotary machine, even more particular the compressor and gas feeding pipe 55; and
- a gas conduit 59 being in direct fluidic connection with inner environment 11 and pumping device 53, in particular the rotary machine, even more particular the compressor.

Thus, in use, sterile gas is withdrawn from inner environment 11 through gas conduit 59, is then pressurized (compressed) by pumping device 53, in particular the rotary machine, even more particular the compressor, and is then directed into second space 50 through gas conduit 58 and gas feeding pipe 55.

Preferentially but not necessarily, delimiting element 48 is removably connected to at least a portion of filling pipe 31 and/or gas feeding pipe 55. In particular, delimiting element 48 is connected to at least a portion of filling pipe 31 and/or gas feeding pipe 55 in a floating manner (i.e. with play). In particular, in a floating manner means that delimiting element 48 is adapted to (slightly) move parallel and/or transversal to at least axis M (and to axis L). In other words, delimiting element 48 is adapted to (slightly) move parallel and/or transversal to the, in use, advancing tube 3.

In the specific case shown in FIGS. 1 and 2, delimiting element 48 is removably connected to gas feeding pipe 55.

In use, packaging apparatus 1 forms packages 2 filled with a pourable product. In particular, packaging apparatus 1 forms packages 2 from tube 3 formed from web 4, tube 3 being continuously filled with the pourable product.

In more detail, operation of packaging apparatus 1 comprises:

- a first advancement step for advancing web 4 along path P;
- a tube forming and sealing step during which web 4 is formed into tube 3 and tube 3 is longitudinally sealed, in particular along seam portion 23;
- a second advancement step during which tube 3 is advanced along path Q;
- a filling step during which the pourable product is filled into tube 3; and
- a package forming step during which packages 2 are formed from tube 3, in particular by shaping (respective (lower) portions) of tube 3 and transversally sealing and cutting tube 3.

In further detail, the tube forming and sealing step comprises the sub-step of gradually overlapping first edge 16 and second edge 17 with one another for forming seam portion 23 and the sub-step of longitudinally sealing tube 3, in particular seam portion 23.

The filling step comprises the sub-step of directing the pourable product through filling pipe 31 into second space 48.

During the package forming step, packages 2 are formed by operation of package forming unit 15, which receives tube 3 after the tube forming and sealing step. In particular, during the package forming step operative assemblies 35 and counter-operative assemblies 36 are advanced along their respective conveying paths. When operative assemblies 35 and their respective counter-operative assemblies 36 advance along their respective operative portions, operative assemblies 35 and the respective counter-operative assemblies 36 cooperate with one another for shaping, transversally sealing and, preferably but not necessarily, transversally cutting advancing tube 3 so as to form packages 2. During the package forming step, the pourable product is continuously directed into second space 50 so as to obtain filled packages 2.

Operation of packaging apparatus 1 also comprises a pressurizing step during which sterile gas, in particular the pressurized (compressed) sterile gas is directed, in particular continuously directed, into second space 50.

In more detail, during the pressurizing step, sterile gas is directed, in particular continuously directed, into second space 50 for obtaining a gas pressure within second space 50 which ranges between 5 kPa to 40 kPa (0.05 bar to 0.40 bar), in particular between 10 kPa to 30 kPa (0.10 bar to 0.30 bar), above ambient pressure.

In particular, second space 50 contains the pourable product and the pressurized sterile gas.

Preferentially but not necessarily, during the pressurizing step a leakage flow of sterile gas is established from second space 50 to first space 49. In particular, sterile gas flows from second space 50 to first space 49 through fluidic channel 51.

According to a preferred non-limiting embodiment, during the pressurizing step, the sterile gas is withdrawn from isolation chamber 10, in particular from inner environment 11, is pressurized (compressed) and then directed, in particular continuously directed, into second space 50.

In even further detail, during the pressurizing step, pumping device 53, in particular the rotary machine, even more particular the compressor, withdraws the sterile gas from isolation chamber 10, in particular from inner environment 11, pressurizes (compresses) the sterile gas and directs the pressurized (compressed) gas through gas feeding pipe 55 into second space 50.

During the pressurizing step, the operating parameters of pumping device 53 are controlled by control unit 54 in function of at least one of the advancement speed of web 4 and/or the advancement speed of tube 3 and/or the format and/or the shape of the packages to be formed and/or the volume of the packages to be formed.

In more detail, control unit 54 controls the rotation speed of the rotary machine, in particular the compressor, as a function of at least one of the advancement speed of the web of packaging material and/or the advancement speed of the tube and/or the format and/or the shape of the packages to be formed and/or the volume of the packages to be formed.

The advantages of packaging apparatus 1 according to the present invention will be clear from the foregoing description.

In particular, delimiting element 48 allows to obtain a high-pressure second space 50 and a low-pressure first space 49. The pressurized sterile gas within second space 50 replaces the action of the pourable product column for obtaining the required hydrostatic pressure for correctly forming packages 2. This allows to reduce the extension, in particular the vertical extension of isolation chamber 10. Furthermore, it is of advantage to arrange delimiting element 48 within isolation chamber 10 (in contrast to being arranged e.g. within package forming unit 15) so that in the rare case of a collapse of tube 3 and/or seam portion 23 in the area of delimiting element 48—in the worst case—sterile gas and not contaminated gases would contact the inside of tube 3 and/or filling pipe 31 and/or delimiting element 48 and/or gas feeding pipe 55.

Additionally, as the hydrostatic pressure is obtained by the sterile gas and not by the pourable product column, the modification works needed to be applied to packaging apparatus 1 in case of a format change or in case of a change in the production speed are minimal and require significant less time than with respect to apparatuses in which the hydrostatic pressure is obtained by means of the pourable product column.

A further advantage resides in that due to the leakage flow of sterile gas from second space 50 to first space 49 the gas pressure within second space 50 can be accurately controlled. In particular, the leakage flow of sterile gas from second space 50 to first space 49 allows to reduce the risk of the evolution of steep gradients in pressure over time.

An even further advantage lies in providing for a design of delimiting element 48 such that fluidic channel 51 is provided by a gap between the inner surface of tube 3 and delimiting element 48. Thus, there is no contact between delimiting element 48 and the inner surface of tube 3. Therefore, delimiting element 48 does not damage the inner surface of tube 3. As well, the risk of debris particles entering package 2 is significantly limited.

An even further advantage resides in the fact that the sterile gas directed into second space 50 is taken from inner environment 11. Thus, no additional sterile gas sources are required, simplifying the design of apparatus 1 and the control of the sterile gas flows.

Clearly, changes may be made to packaging apparatus 1 as described herein without, however, departing from the scope of protection as defined in the accompanying claims.

In an alternative embodiment not shown, the filling pipe and the gas feeding pipe could be arranged spaced apart and parallel to one another.

In a further alternative embodiment not shown, the delimiting element could be designed to abut, in use, against the inner surface of tube 3 and the delimiting element could be provided with an aperture or apertures for allowing for the at least one fluidic channel fluidically connecting the second space with the first space.

The invention claimed is:

1. A packaging apparatus for forming a plurality of sealed packages filled with a pourable product comprising:

a conveying device adapted to advance a web of packaging material along an advancement path;

an isolation chamber separating an inner environment containing a sterile gas from an outer environment;

a tube forming and sealing device at least partially arranged within the isolation chamber and configured to form and longitudinally seal a tube from the, in use, advancing web of packaging material;

wherein the conveying device is also configured to advance the tube along a tube advancement path;

a delimiting element, in use, positioned entirely within the tube and configured to divide the tube in a first space in fluidic connection with the inner environment and a second space arranged downstream of the first space along the tube advancement path, the delimiting element positioned entirely within the isolation chamber;

a filling device configured to direct, in use, a pourable product into the second space, the second space positioned at least partially outside the isolation chamber and configured to receive the pourable product, wherein the filling device comprises a filling outlet configured to release the pourable product into the second space;

a pressurizing device configured to direct, in use, a flow of sterile gas into the second space of the tube for obtaining a gas pressure within the second space that is higher than the gas pressure within the first space;

a package forming unit adapted to at least form and transversally seal the packages from the, in use, advancing tube;

wherein the isolation chamber comprises an outlet-opening for allowing the tube to exit the isolation chamber during advancement of the tube along the tube advancement path;

wherein the delimiting element is arranged upstream of the outlet-opening along the tube advancement path; and wherein the filling outlet of the filling device is positioned downstream of the outlet-opening of the isolation chamber along the tube advancement path.

2. The packaging apparatus according to claim 1, wherein the isolation chamber comprises a sealing assembly configured to seal, in use, the outlet-opening in cooperation with the, in use, advancing tube.

3. The packaging apparatus according to claim 1, wherein the delimiting element is designed to provide, in use, at least one fluidic channel for fluidically connecting the second space with the first space and for allowing, in use, a leakage flow of sterile gas from the second space into the first space.

4. The packaging apparatus according to claim 3, wherein the fluidic channel has an annular shape.

5. The packaging apparatus according to claim 3, wherein, in use, the fluidic channel is delimited by a peripheral portion of the delimiting element and the inner surface of the, in use, advancing tube.

6. The packaging apparatus according to claim 1, wherein the pressurizing device is configured to control the gas pressure within the second space to range between 5 kPa to 40 kPa above ambient pressure.

7. The packaging apparatus of claim 6, wherein the range is between 10 kPa to 30 kPa above ambient pressure.

8. The packaging apparatus according to claim 1, wherein the pressurizing device is fluidically connected to the inner environment of the isolation chamber and is adapted to direct, in use, at least a portion of the sterile gas present in the inner environment into the second space of the tube.

9. The packaging apparatus according to claim 8, wherein the pressurizing device comprise:

at least one pumping device; and at least one control unit adapted to control the operating parameters of the pumping device as a function of at least one of the advancement speed of the web of packaging material and/or the advancement speed of the tube and/or the format and/or the shape of the packages to be formed and/or the volume of the packages to be formed.

10. The packaging apparatus according to claim 9, wherein the pumping device is a rotary machine, and the control unit is adapted to control the rotation speed of the rotary machine as a function of at least the advancement speed of the web of packaging material or the advancement speed of the tube or the format or the shape of the packages to be formed or the volume of the packages to be formed.

11. The packaging apparatus of claim 10, wherein the rotary machine is a compressor.

12. The packaging apparatus according to claim 1, wherein the filling device comprises at least a filling pipe, in use, at least partially extending within the tube and being adapted to direct, in use, the pourable product into the second space; and wherein the pressurizing device comprises a gas feeding pipe being at least indirectly fluidically connected with the inner environment and the second space for directing the sterile gas from the inner environment into the second space.

13. The packaging apparatus according to claim 12, wherein at least a portion of the gas feeding pipe and at least a portion of the filling pipe are coaxially arranged to one another.

14. The packaging apparatus according to claim 12, wherein the delimiting element is connected to at least a portion of the filling pipe and/or the gas feeding tube.

15. The packaging apparatus according to claim 1, wherein the delimiting element is adapted to move along a direction parallel to the, in use, advancing tube.

16. The packaging apparatus of claim 1, wherein the pressurizing device is configured to vary the flow of the sterile gas into the second space such that the gas pressure within the second space remains substantially constant.

17. The packaging apparatus of claim 1, wherein the delimiting element comprises a curved outer profile.

18. The packaging apparatus of claim 1, wherein the outlet-opening of the isolation chamber is located between the delimiting element and the filling outlet, along the tube advancement path.

19. The packaging apparatus of claim 1, wherein the delimiting element comprises an inner edge that is fixedly attached to the filling device.

20. The packaging apparatus of claim 1, wherein the delimiting element comprises a continually downward profile from an inner edge of the delimiting element to an outer edge of the delimiting element.

* * * * *